US011203903B2

(12) United States Patent
Daniels et al.

(10) Patent No.: US 11,203,903 B2
(45) Date of Patent: Dec. 21, 2021

(54) PERCUSSION DRILL BIT WITH AT LEAST ONE WEAR INSERT, RELATED SYSTEMS, AND METHODS

(71) Applicant: APERGY BMCS ACQUISITION CORPORATION, Orem, UT (US)

(72) Inventors: Grant K. Daniels, Spanish Fork, UT (US); Nathan A. Tulett, Orem, UT (US)

(73) Assignee: APERGY BMCS ACQUISITION CORPORATION, Orem, UT (US)

( * ) Notice: Subject to any disclaimer, the term of this patent is extended or adjusted under 35 U.S.C. 154(b) by 0 days.

(21) Appl. No.: 16/585,518

(22) Filed: Sep. 27, 2019

(65) Prior Publication Data

US 2020/0024902 A1 Jan. 23, 2020

Related U.S. Application Data

(63) Continuation of application No. 15/311,104, filed as application No. PCT/US2015/029531 on May 6, 2015, now Pat. No. 10,487,588.
(Continued)

(51) Int. Cl.
*E21B 10/36* (2006.01)
*E21B 17/10* (2006.01)
(Continued)

(52) U.S. Cl.
CPC ..... *E21B 10/36* (2013.01); *E21B 10/567* (2013.01); *E21B 17/1092* (2013.01); *E21B 6/00* (2013.01)

(58) Field of Classification Search
CPC ..... E21B 10/36; E21B 10/567; E21B 10/52; E21B 10/55; E21B 10/56; E21B 10/46; E21B 17/1092
See application file for complete search history.

(56) References Cited

U.S. PATENT DOCUMENTS 1,477,855 A 12/1923 Thurston
4,106,578 A 8/1978 Beyer
(Continued)

FOREIGN PATENT DOCUMENTS

RU 2252306 C2 5/2005
WO 2006054933 A1 5/2006

OTHER PUBLICATIONS

International Search Report for International Application No. PCT/US2015/029531 dated Aug. 20, 2015.
(Continued)

*Primary Examiner* — David Carroll
(74) *Attorney, Agent, or Firm* — Dorsey & Whitney LLP

(57) ABSTRACT

Various drill bits, drilling systems and related methods are provided. In one embodiment, a drill bit comprises a bit body having a face and a shank, at least one insert having a convex engagement surface coupled with the face and at least one wear insert coupled with the shank. In one particular embodiment, the at least one wear insert may be positioned immediately adjacent a coupling end of the shank. The at least one wear insert may include a superabrasive table which may be bonded with a substrate. The at least one wear insert includes a wear surface defined in the superabrasive table. In one embodiment, the superabrasive table may comprise polycrystalline diamond. Similarly, the inset having a convex engagement surface may include a superabrasive material, such as polycrystalline diamond, bonded with a substrate. Such a drill bit may be used, for example, in a top hammer percussion drilling operation.

20 Claims, 12 Drawing Sheets

Related U.S. Application Data

(60) Provisional application No. 61/993,921, filed on May 15, 2014.

(51) Int. Cl.
*E21B 10/567* (2006.01)
*E21B 6/00* (2006.01)

(56) References Cited

U.S. PATENT DOCUMENTS 4,168,755 A * 9/1979 Willis ..... E21B 10/04 175/215
4,660,659 A 4/1987 Short et al.
5,178,222 A 1/1993 Jones et al.
5,743,345 A 4/1998 Hollar et al.
6,138,780 A 10/2000 Beuershausen
6,349,780 B1 2/2002 Beuershausen
6,494,275 B2 12/2002 Aasberg et al.
7,281,594 B2 * 10/2007 Hadin ..... E21B 10/36 175/320
7,527,110 B2 5/2009 Hall et al.
7,866,418 B2 1/2011 Bertagnolli et al.
8,061,458 B1 11/2011 Bertagnolli et al.
8,061,485 B2 11/2011 Finschi
9,866,418 B2 1/2018 Hassan et al.
2002/0153174 A1 10/2002 Linden et al.
2010/0025114 A1 * 2/2010 Brady ..... E21B 10/36 175/57
2012/0125687 A1 5/2012 Rives

OTHER PUBLICATIONS

U.S. Appl. No. 15/311,104, filed Nov. 14, 2016.
U.S. Appl. No. 61/993,921, filed May 15, 2014.

* cited by examiner

PERCUSSION DRILL BIT WITH AT LEAST ONE WEAR INSERT, RELATED SYSTEMS, AND METHODS

CROSS-REFERENCE TO RELATED APPLICATIONS

This application is a continuation of U.S. application Ser. No. 15/311,104 filed on 14 Nov. 2016, which is a National Phase of International Application No. PCT/US2015/029531 filed on 6 May 2015, which claims priority to U.S. Provisional Application No. 61/993,921 filed on 15 May 2014, the disclosure of each of the foregoing applications is incorporated herein, in its entirety, by this reference.

BACKGROUND

Various types of drill bits are employed when drilling formations in association with, for example, mining activities and oil and gas exploration. One particular type of drill bit is known as a percussion or hammer drill bit. Percussion type drill bits are positioned on the end of a drill string and engage a formation while impacting the formation and also rotating relative to the formation. While in other drill bits, the primary mode of action may be shearing of the formation due to the rotation of the drill bit, percussion drilling relies heavily on the impact mechanism for penetrating the formation. Thus as the drill bit impacts the formation and rotates relative to the formation, a borehole is formed that is approximately the same diameter as the outer radius of the drill bit. Percussion type drilling systems are often employed when a hard formation (e.g., rock) is anticipated during drilling.

Different types of systems may be used in percussion drilling. For example, one system is known as a "top hammer" system where the drill bit is placed at the end of a drill string. The drill string includes a rod coupled with the drill bit and, at an upper end of the drill string, the rod is coupled to a percussion mechanism and a rotary mechanism. In other words, the impact action and the rotational action are each provided to the drill bit from the top end of the drill string.

In another example, a down-the-hole (DTH) system (sometimes referred to as an in-the-hole system) includes a drill bit that is placed at the end of the drill string. A cylinder containing a percussion mechanism (e.g., a reciprocating piston), often referred to as a "hammer," is coupled directly with the drill bit and positioned "down hole" during operation of the drill string. Rotation may still be imparted to the drill bit by a rotational mechanism, whether positioned at the top end of the drill string or elsewhere.

The type of drilling system being used influences the design, features and size of the drill bit. For example, the coupling mechanism used for a top hammer drill bit is conventionally a threaded coupling. The threaded coupling may include a tapered neck that provides frictional engagement between the drill bit and the rod. The entire drill bit is typically exposed within the borehole during a top hammer operation.

A DTH drill bit usually includes a splined surface (e.g., on the shank) for engagement with the cylinder/hammer mechanism enabling it to slide axially relative to the cylinder during percussion activities. A substantial portion of the drill bit (e.g., the splined shank) is conventionally disposed within the cylinder of a hammer mechanism and, thus, is not directly exposed to the formation during drilling activities due to its coupling with the cylinder.

As noted above, size may also be a feature that is at least partially determined by the type of drilling system being employed. For example, a top hammer system is typically employed for drilling of holes that are approximately 125 mm in diameter or less (the gage portion or outer diameter of the drill bit substantially corresponding with the bore hole diameter). On the other hand, DTH systems are conventionally employed for drilling holes that are greater than 125 mm in diameter.

One of the weaknesses of a top hammer type drill bit is the wear experienced by portions of the bit other than the inserts or "cutters." As noted above, the entire drill bit body is exposed to the bore hole causing it to experience wear in features and locations other than just the cutting elements of the drill bit. For example, portions of the shank of a drill bit may experience wear, causing it to overheat and deform. In some instances, the shank may even "weld" itself to the rod that is coupled with the drill bit resulting in the loss of not only the drill bit, but the rod as well.

It is a continuous desire in the industry to provide drill bits and drilling systems having improved performance characteristics including improved wear performance, thermal characteristics and useful life.

BRIEF SUMMARY OF THE INVENTION

In accordance with the present invention, various embodiments of drill bits, drilling systems and related methods are provided. In one embodiment, a drill bit comprises a bit body having a face and a shank, at least one insert having a convex engagement surface coupled with the face and at least one wear insert coupled with the shank.

In one embodiment, the at least one wear insert is immediately adjacent a coupling end of the shank. In one embodiment, a portion of the at least one wear insert is contiguous with the coupling end of the shank.

In an embodiment of the invention, the at least one wear insert includes a superabrasive table bonded with a substrate. The at least one wear insert includes a wear surface defined in the superabrasive table. In one embodiment, the superabrasive table comprises polycrystalline diamond.

In one embodiment internal threads are formed in the shank. In another embodiment, an interior tapered interface surface is formed within the shank.

In one embodiment, the face of the drill bit body exhibits a diameter of between approximately 1 inch and approximately 3 inches.

In one embodiment, wherein the at least one wear insert is disposed within a pocket formed in the shank. In one embodiment, a wear surface of the at least one wear insert is substantially flush with an immediately adjacent surface of the shank. In another embodiment, a wear surface of the at least one wear insert extends radially beyond an immediately adjacent surface of the shank.

In one embodiment, the at least one wear insert exhibits a thickness of less than approximately 0.25 inch. In one particular embodiment, the at least one wear insert exhibits a thickness of approximately 0.063 inch.

In one embodiment, the at least one wear insert is substantially elongated with its length oriented substantially parallel to a longitudinal axis of the drill bit.

In one embodiment, the at least one wear insert includes at least three wear inserts substantially equally spaced about a circumference of the shank.

In one embodiment, the drill bit further comprises at least one additional wear insert positioned in an end face of the shank opposite of the face.

In one embodiment, the drill bit body includes a plurality of gage portions and a plurality of flutes arranged in an alternating pattern and a skirt portion extending from the face and tapering down to the shank, wherein the drill bit further includes at least one additional wear insert positioned in the skirt portion adjacent a gage portion of the plurality of gage portions.

In one embodiment, the at least one additional wear insert includes a plurality of additional wear inserts, each additional wear insert being associated with one of the plurality of gage portions.

In one embodiment, the at least one insert having a convex engagement surface includes a superabrasive table bonded with a substrate. In a particular embodiment, the superabrasive table comprises polycrystalline diamond.

In accordance with another embodiment of the present invention, a drilling system is provided. The drilling system includes a drill bit comprising a bit body having a face and a shank, a threaded internal surface formed within the shank, at least one insert having a convex engagement surface coupled with the face and at least one wear insert coupled with the shank. the drilling system further includes a drive rod having a threaded surface engaging the threaded internal surface of the shank.

In one embodiment, the drilling system includes a flow passage formed in the bit body including an outlet formed in the face. In accordance with one embodiment, the system further includes a channel formed in the drive rod in communication with the flow passage.

The drill bit of the drilling system may include a variety of other features and elements such as described in accordance with other embodiments.

Features or aspects of any embodiment of the invention may be combined with features or aspects of other embodiments described herein without limitation.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
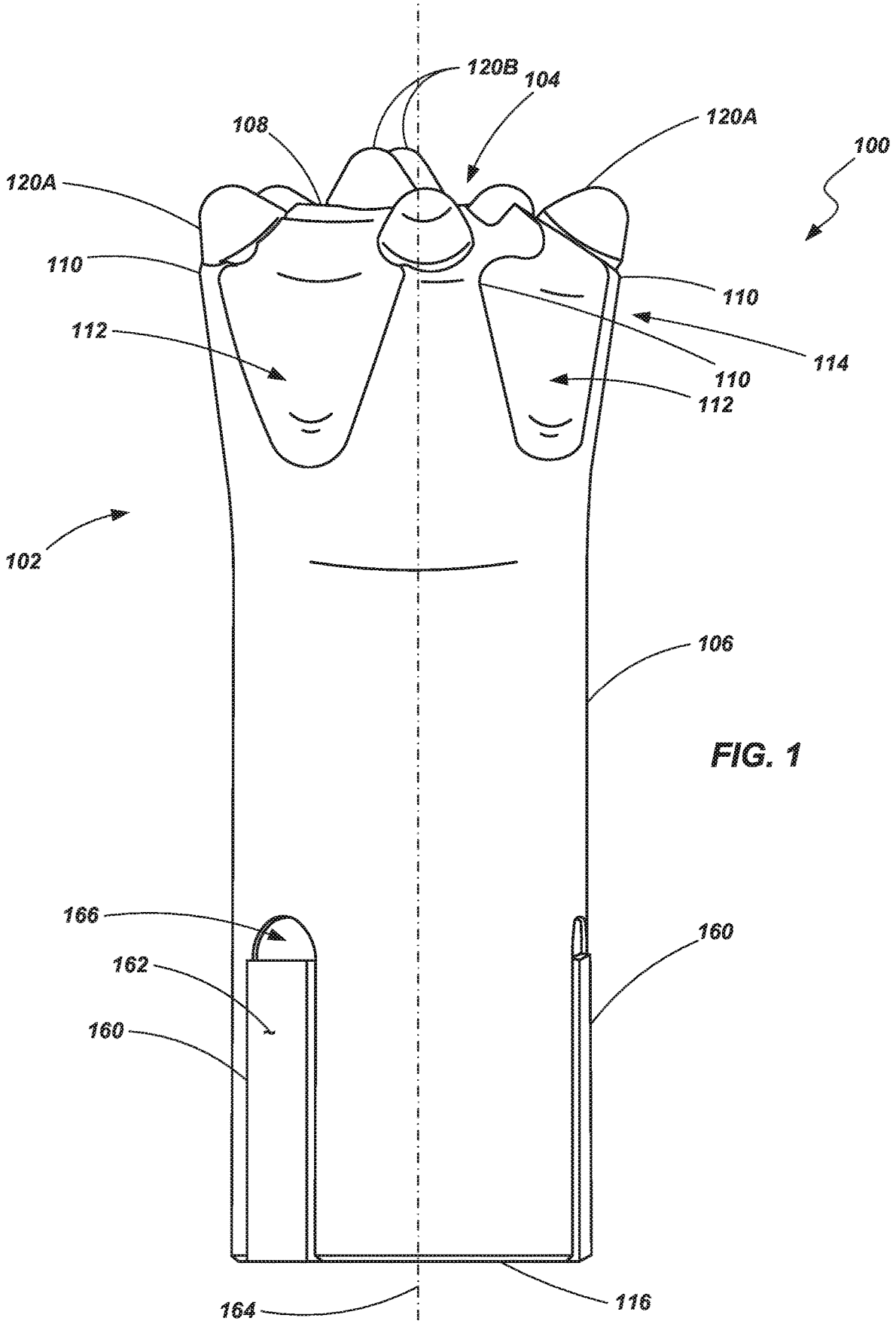
FIG. 1 is a side view of a percussion drill bit according to an embodiment of the present invention.
Figure 2:
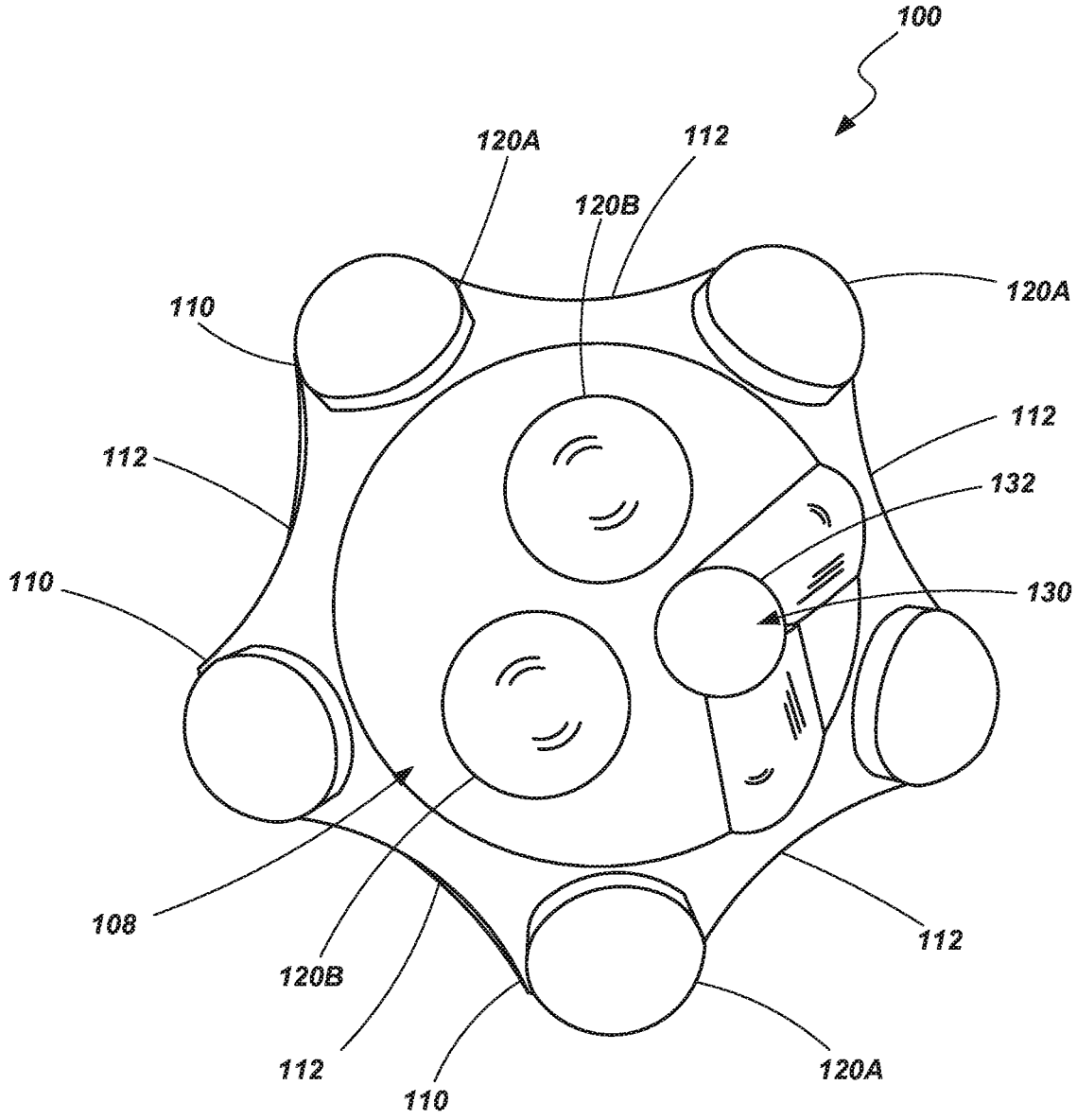
FIG. 2 is top view of the drill bit shown in FIG. 1.

Referring to FIGS. 1-4, a drill bit 100 is shown according to an embodiment of the present invention. The drill bit 100 includes a bit body 102 having a head 104 and a shank 106. The head may include a face 108 or a working end having a plurality of wings or gage portions 110 and a plurality of flutes 112 disposed between the gage portions 110. The flutes 112 may be configured as radially recessed portions that enable fluid and other materials (such as crushed formation materials) to pass during drilling operations. The drill bit 100 includes a skirt 114 which includes at least the section that tapers radially inwardly as it extends axially from the face 108 toward the shank 106. A coupling end 116 is located opposite the face 108 at the end of the shank 106. The drill bit 100, and its various features including the head 104 and the shank 106, may be formed, for example, of a metal or metal alloy material such as steel, although other materials may be utilized. In one embodiment, the bit body 102 may be formed of a single unitary volume of material that is forged and/or machined, although it may be formed using other appropriate manufacturing techniques.

A plurality of inserts 120 may be positioned in the face 108 of the drill bit for engagement with a formation being drilled. For example, one or more gage inserts 120A may be positioned in or near the gage portions 110 of the face 108, and one or more central inserts 120B may be positioned radially inward from the gage inserts 120A. The inserts 120 may be coupled with the drill bit 100, for example, by positioning the inserts 120 in pockets formed in the drill bit 100 and by securing them by way of a press-fit, by brazing, or by other appropriate joining or fastening techniques.

Figure 5A:
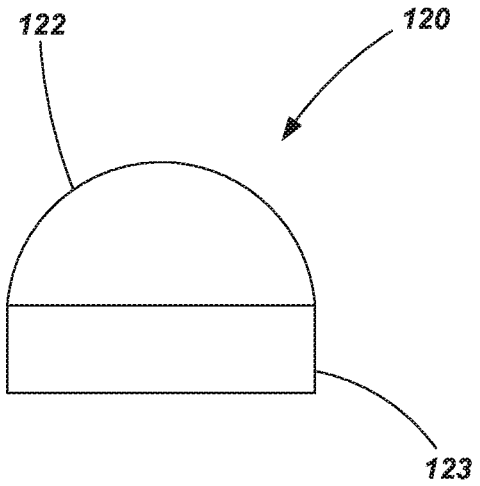
FIGS. 5A and 5B are side and cross-section views, respectively, of an insert used in the working face of a percussion drill bit according to one embodiment of the invention.
Figure 5B:
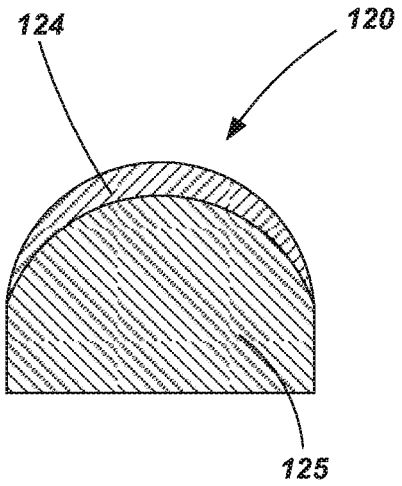

As shown in FIGS. 5A, 5B, 6 and 7, the inserts 120 may exhibit a variety of geometries and include a variety of features. Referring first to FIG. 5A, in one embodiment, the inserts 120 may include a domed or generally convex, arcuate working surface 122 configured to engage a formation during drilling operations. In the embodiment shown in FIGS. 5A and 5B, the working surface is shown to include a substantially semi-spherical surface (e.g., substantially half of the surface of a sphere). A lower portion 123 may exhibit, for example, a substantially cylindrical geometry, and be configured for positioning in a pocket formed in the face 108 of a drill bit 100. As seen in FIG. 5B, which is a cross-sectional view of the insert 120 shown in FIG. 5B, the insert 120 may include a superhard or superabrasive material layer 124 formed on and bonded to a substrate 125.

"Superhard," as used herein, refers to any material having a hardness that is at least equal to a hardness of tungsten carbide. Additionally, a "superabrasive material," as used herein, may refer to a material exhibiting a hardness exceeding a hardness of tungsten carbide, such as, for example, polycrystalline diamond.

In one example embodiment, the material layer 124 may include a polycrystalline diamond (PCD) body bonded to the substrate 125 during a high-pressure, high-temperature (HPHT) sintering process. The PCD body may be formed by subjecting diamond particles in the presence of a catalyst to HPHT sintering conditions. The catalyst may be, for example, in the form of a powder, a disc, a foil, or in a cemented carbide substrate. In various embodiments, the PCD layer may be formed independently from or integrally with a substrate, both under HPHT conditions. When formed independently from a substrate, the PCD layer may be used on its own, or it may be subsequently attached to a substrate or other backing or support structure.

Considering the example of a PCD body formed integrally with a substrate, a PCD body 124 (also referred to as a PCD table or PCD layer) may be fabricated by subjecting a plurality of diamond particles (e.g., diamond particles having an average particle size between 0.5 μm to about 150 μm) and a substrate to a HPHT sintering process in the presence of a catalyst, such as a metal-solvent catalyst, cobalt, nickel, iron, a carbonate catalyst, an alloy of any of the preceding metals, or combinations of the preceding catalysts to facilitate intergrowth between the diamond particles and form the PCD body 124 comprising directly bonded-together diamond grains (e.g., exhibiting $sp^3$ bonding) defining interstitial regions with the catalyst disposed within at least a portion of the interstitial regions. In order to effectively HPHT sinter the plurality of diamond particles, the particles and substrate may be placed in a pressure transmitting medium, such as a refractory metal can, graphite structure, pyrophyllite or other pressure transmitting structure, or another suitable container or supporting element. The pressure transmitting medium, including the particles and substrate, may be subjected to an HPHT process using an HPHT press at a temperature of at least about 1000° C. (e.g., about 1300° C. to about 1600° C.) and a cell pressure of at least 4 GPa (e.g., about 5 GPa to about 10 GPa, or about 7 GPa to about 9 GPa) for a time sufficient to sinter the diamond particles and form a PCD body 124 that bonds to the substrate 125. In some embodiments, a PCD body 124 may be formed by sintering diamond particles in an HPHT process without a substrate present. A PCD body may be formed by sintering diamond particles in the presence of a catalyst not supplied from a substrate, by way of non-limiting example, a powder, a wafer, or a foil.

In one embodiment, when the PCD body 124 is formed by sintering the diamond particles in the presence of the substrate 125 in a first HPHT process, the substrate 125 may include cobalt-cemented tungsten carbide from which cobalt or a cobalt alloy infiltrates into the diamond particles and catalyzes formation of PCD. For example, the substrate 125 may comprise a cemented carbide material, such as a cobalt-cemented tungsten carbide material or another suitable material. Nickel, iron, and alloys thereof are other catalysts that may form part of the substrate 125. The substrate 125 may include, without limitation, cemented carbides including titanium carbide, niobium carbide, tantalum carbide, vanadium carbide, and combinations of any of the preceding carbides cemented with iron, nickel, cobalt, or alloys thereof. However, in other embodiments, the substrate 125 may be replaced with a catalyst material disc and/or catalyst particles may be mixed with the diamond particles. In other embodiments, the catalyst may be a carbonate catalyst selected from one or more alkali metal carbonates (e.g., one or more carbonates of Li, Na, and K), one or more alkaline earth metal carbonates (e.g., one or more carbonates of Be, Mg, Ca, Sr, and Ba), or combinations of the foregoing. The carbonate catalyst may be partially or substantially completely converted to a corresponding oxide of Li, Na, K, Be, Mg, Ca, Sr, Ba, or combinations after HPHT sintering of the plurality of diamond particles. The diamond particle size distribution of the plurality of diamond particles may exhibit a single mode, or may be a bimodal or greater distribution of grain size. In one embodiment, the diamond particles may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger average particle size (e.g., 50 μm, 40 μm, 30 μm, 20 μm, 15 μm, 12 μm, 10 μm, 8 μm) and another portion exhibiting at least one relatively smaller average particle size (e.g., 6 μm, 5 μm, 4 μm, 3 μm, 2 μm, 1 μm, 0.5 μm, less than 0.5 μm, 0.1 μm, less than 0.1 μm). In one embodiment, the diamond particles may include a portion exhibiting a relatively larger average particle size between about 10 μm and about 40 μm and another portion exhibiting a relatively smaller average particle size between about 1 μm and 4 μm. In some embodiments, the diamond particles may comprise three or more different average particle sizes (e.g., one relatively larger average particle size and two or more relatively smaller average particle sizes), without limitation.

When sintered using a catalyst material, the catalyst material may remain in interstitial spaces between the bonded diamond grains. In various embodiments, at least some of the catalyst material may be removed from the interstitial spaces of the superabrasive hard or superabrasive body 124. For example, catalyst material may be removed (such as by acid-leaching) to a desired depth from a working surface of the body 124. In one embodiment, catalyst material may be substantially removed from the body 124 from a working surface (e.g., a top surface, a side surface, or any desired surface which may include a surface expected to engage with a subterranean material during cutting/drilling activities) to a depth between approximately 50 μm to approximately 100 μm. In other embodiments, catalyst materials may be removed to a lesser depth or to a greater depth. Removal of the catalyst material to provide a substantially catalyst free region (or at least a catalyst-lean region) provides a table that is thermally stable by removing the catalyst material, which exhibits a substantially different coefficient of thermal expansion than the diamond material, in a region or the table expected to see substantial temperature increases during use. In one embodiment, the interstitial areas of the leached region remain substantially material free. In some embodiments, a second material (i.e., a material that is different from the catalyst material) may be introduced into the interstitial spaces from which catalyst material has been removed. Some examples of materials that may be subsequently introduced into such interstitial spaces, and methods of introducing such materials into the interstitial spaces, are set forth in U.S. Pat. No. 8,061,458 to Bertagnolli et al., issued Nov. 22, 2011, the disclosure of which is incorporated by reference herein in its entirety.

Figure 6:
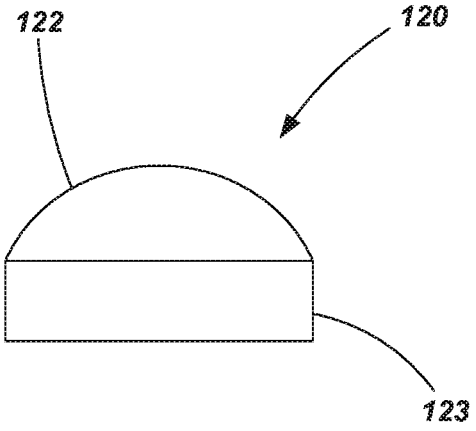
FIGS. 6 and 7 are side views of inserts that may used in association with a percussion drill bit according to various embodiments of the present invention.

Referring briefly to FIG. 6, another embodiment of an insert 120 is shown wherein the insert 120 includes a domed or convex arcuate surface 122. The arcuate surface 122 may be "substantially spherical" in the sense that it includes a portion of a surface of sphere. However, as compared to the insert 120 shown in FIGS. 5A and 5B, the arcuate working surface 122 includes less than one-half of a sphere's surface and, thus, does not include a substantially tangent transition between the arcuate (domed) surface 122 and the sidewall of the lower cylindrical portion of the insert 120 as is exhibited in FIGS. 5A and 5B. In some embodiments, if desired, a transition surface may be positioned between the substantially spherical surface 122 and the substantially cylindrical sidewall of the lower portion 123.

Figure 7:
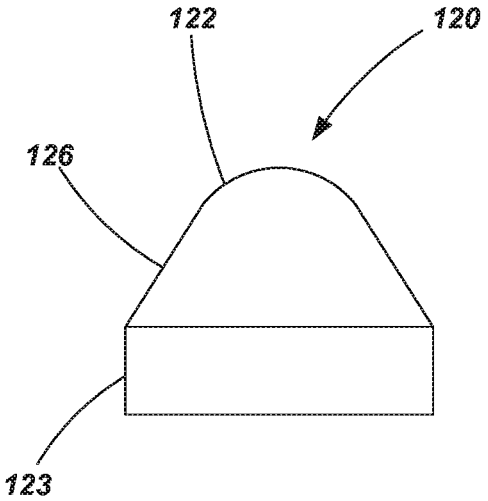

Referring briefly to FIG. 7, another embodiment of an insert 120 is shown wherein the insert 120 includes a domed or convex arcuate surface 122. The arcuate surface 122 may be "substantially spherical" in the sense that it includes a portion of a surface of sphere. A portion of the working surface of the insert 120 may also include a substantially conical surface 126 (i.e., a portion of a surface of a cone) that is positioned between the spherical surface 123 and the sidewall of the lower cylindrical portion 123. The substantially conical surface 126 may make an angled transition with the sidewall of the cylindrical sidewall of the lower portion 123, or a transition surface may be formed therebetween. In various embodiments, the substantially spherical portion may be larger or smaller than shown in FIG. 7. In some embodiments, the substantially spherical portion may be reduced in size to make the insert provide more of a pointed profile.

Any of the inserts 120 shown in FIG. 5A, 5B, 6 or 7 (or, indeed, any of the various inserts described herein, including wear inserts 160) may be formed with a superhard or a superabrasive layer such as described in further detail above. Of course, other inserts may include other materials and exhibit other geometries depending, for example, on the properties of the formation to be drilled and the desired performance characteristics of the drill bit 100. Other examples of inserts and processes of making such may be found, for example, in U.S. Pat. No. 7,527,110, issued to Hall et al. on May 5, 2009, and U.S. Pat. No. 7,866,418, issued to Bertagnolli et al. on Jan. 11, 2011, the disclosures of which are incorporated by reference herein in their entireties. Again, such examples may be used in conjunction with any of the inserts described herein.

Returning to FIGS. 1-4, one or more fluid passages 130 may be formed through the bit body 102 and include an outlet 132 or a nozzle formed in the face 108 (as shown) and/or in some other location, such as in flutes 112. The fluid passages may be configured to convey a fluid, such as air, an air-water mist, or some other gas or liquid, from a drill string to the external surface of the drill bit 100 to assist in cooling the drill bit 100 and clearing debris from the drill bit during drilling of a borehole.

Figure 3:
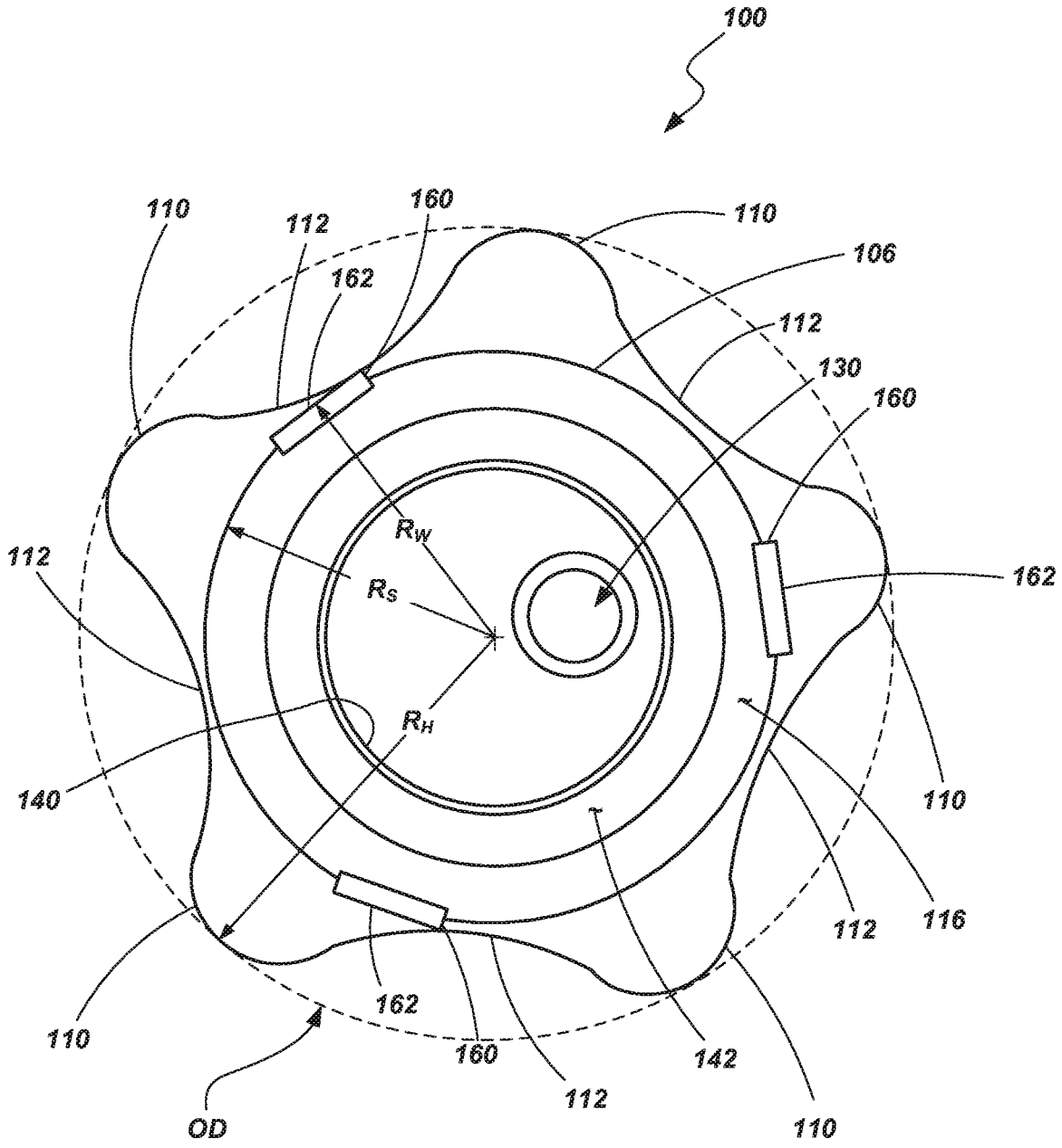
FIG. 3 is a bottom view of the drill bit shown in FIG. 1.
Figure 4A:
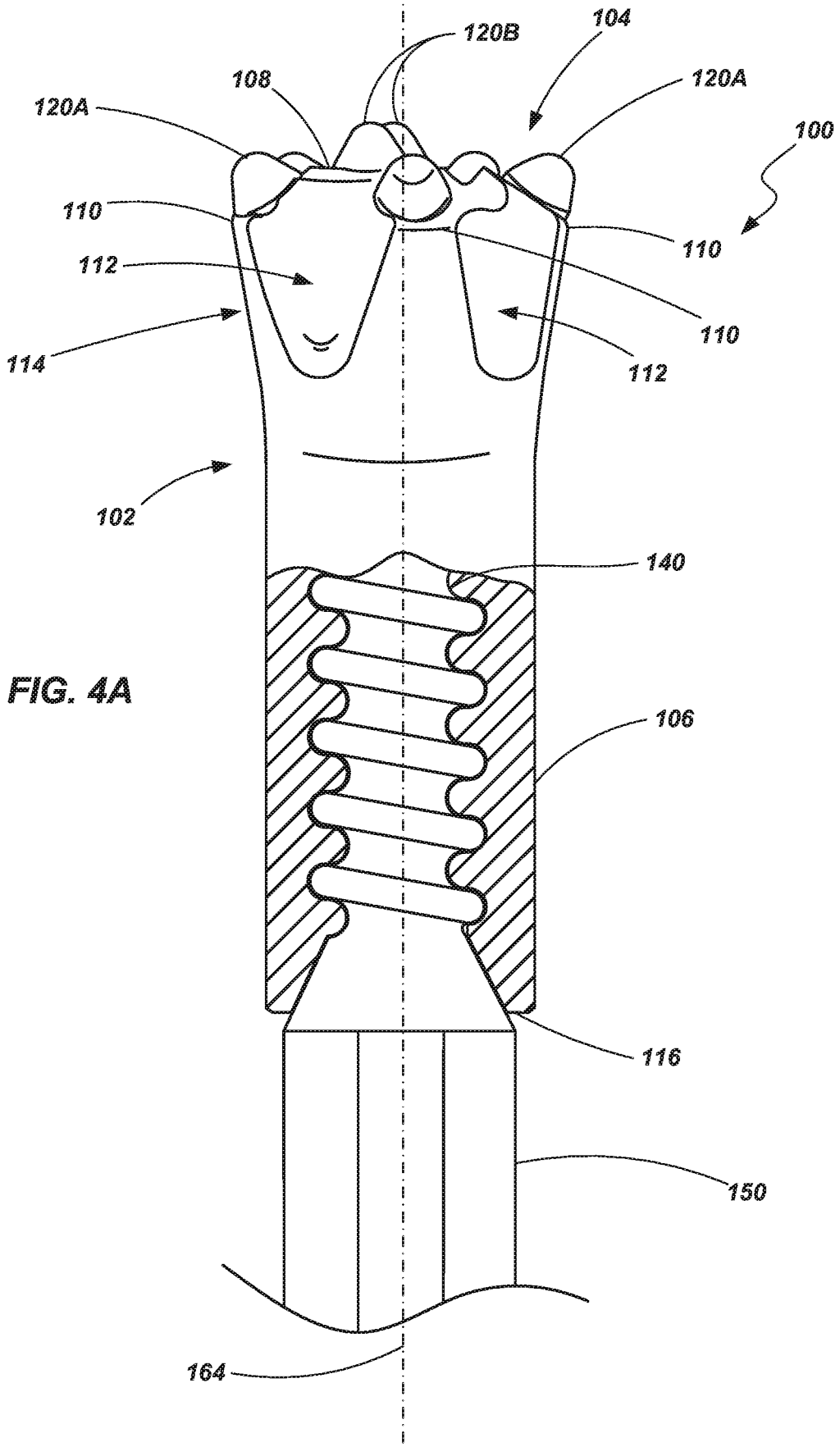
FIGS. 4A and 4B are partial cross-sectional views of the dill bit shown in FIG. 1 coupled with a rod according to certain embodiments.
Figure 4B:
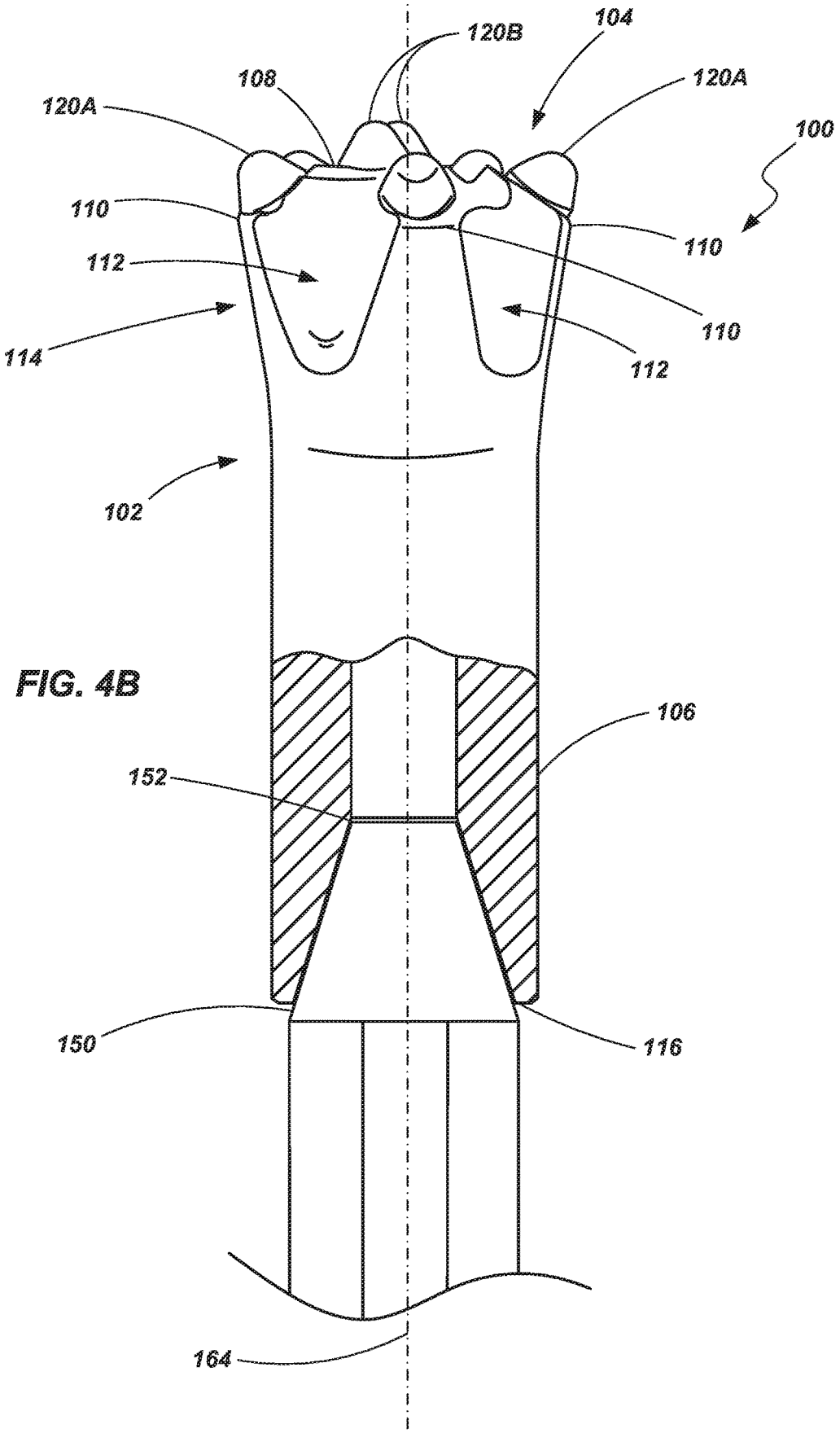

As seen in FIGS. 3 and 4A, the drill bit 100 may be configured for coupling with a drill string by way of a plurality of internal threads 140 formed within the shank portion 106 of the drill bit. Additionally, a tapered engagement surface 142 may be located between the tapered threads 142 and the face of the coupling end 116 and configured for frictional engagement with a drive rod 150 (sometimes referred to as the "drill steel") of the drill string. In another embodiment, as shown in FIG. 4B, the drive rod 150 may engage the drill bit by way of a tapered engagement surface 152 that engages with a generally mating tapered interior surface 154 of the drill bit 100. In such a case, the drive rod 150 drives the drill bit through frictional engagement of the two tapered surfaces 152 and 154. In yet other embodiments, a keyed interface between the drive rod and the drill bit may be employed. For example, the drive rod may be configured to include a hexagonal (or other polygonal) cross-sectional geometry and the interior surface of the drill bit may be configured to cooperatively or matingly engage the geometry of the drive rod 150.

While not specifically shown, a bore may be formed within the drive rod 150 and placed in fluid communication with the fluid passage 124 of the drill bit to pass a drilling fluid to the drill bit 100 from a top end of the drill string during operation of the drill bit. The drive rod 150 may include multiple sections coupled to one another using coupling sleeves to provide a drill string of a desired length, as will be understood by those of ordinary skill in the art.

The drill bit 100 may be operated as a "top-hammer" type drill bit such that impact or percussion action is provided through the drill string (including through the rod 150) from a location that is distal from the drill bit—usually at the top of the borehole. Thus, during a drilling operation, the entirety of the drill bit 100, including the shank 106, is exposed to the borehole and subject to wear and thermal degradation.

One or more wear inserts 160 are provided in the drill bit to inhibit the wear and thermal degradation of the bit 100 during drilling operations. For example, exposure of the shank 106 to the formation during drilling may result in undue wear of the shank 106 as well as an increase in the temperature of the shank 106 (and other portions of the drill bit 100). In some instances, the increased temperature of the shank 106 due to excessive wear may result in the "welding" of a portion of the shank 106 to the drive rod 150, ultimately requiring both components to be replaced.

In accordance with one aspect of the present invention, wear inserts 160 may be positioned at one or more locations within the drill bit to reduce wear in the drill bit 100, including portions other than the face 108 and inserts 120. In the embodiment shown in FIGS. 1-4, three different inserts 160 are positioned near the trailing end of the bit (i.e., adjacent the coupling end 116). In one embodiment, the wear inserts 160 may be positioned so that they provide a generally radial-facing wear surface 162 immediately adjacent, even contiguous with, the coupling end 116 (i.e., the surface axially distal from, and opposite of the face 108 of the drill bit). In other embodiments, the wear inserts 160 may provide a wear surface 162 at a different—or an additional—location between the face 108 of the bit and the coupling end 116 of the bit 100.

As shown in FIGS. 1-4, in one embodiment, three wear inserts 160 may be disposed at substantially equal distances about the circumference of the shank 106 (i.e., positioned substantially 120° from one another about the circumference of the shank 106). In other embodiments, more or fewer wear inserts 160 may be used. Additionally, the wear inserts need not be equally or symmetrically spaced in every embodiment. In the embodiment shown in FIGS. 1-4, the wear inserts 160 are generally elongated, with their lengths being positioned substantially parallel to the longitudinal axis 164 of the drill bit 100 (which generally coincides with the intended axis of rotation). The wear inserts 160 may be coupled with the bit body 102, for example, by disposing them in a pocket or recess 166 formed in the bit body 102 (e.g., within the shank 106) and affixed by way of interference fit, brazing, or other appropriate joining or fastening techniques.

In one embodiment, the wear inserts 160 may be positioned such that their wear surfaces 162 are substantially flush with the immediately adjacent surface of the shank 106 (or other portion of the drill bit 100 to which they are coupled). In another embodiment, the wear inserts 160 may be positioned so that their wear surfaces 162 are at a radial distance from the axis 162 which is greater than the radial distance of the immediately adjacent surface of the shank 106 (or other portion of the drill bit 100 to which they are coupled). In other words, the wear surfaces 162 may be "raised" relative to, or protrude from, immediately adjacent surfaces of the drill bit 100. The wear surfaces 162 may be substantially planar or may be generally arcuate (e.g., convex). If convex, the wear surfaces 162 may exhibit substantially the same radius of curvature as the outer surface of the shank 106 or the may exhibit a greater radius of curvature than the shank 106. However, the wear surfaces 162 may not extend to the outer diameter (OD) or radius $R_H$ of the head 104. For example, the radius of the wear inserts $R_W$ may be between $R_H$ and the radius $R_S$ of the shank 106. $R_w$ may be closer to $R_S$ than $R_W$.

Figure 8:
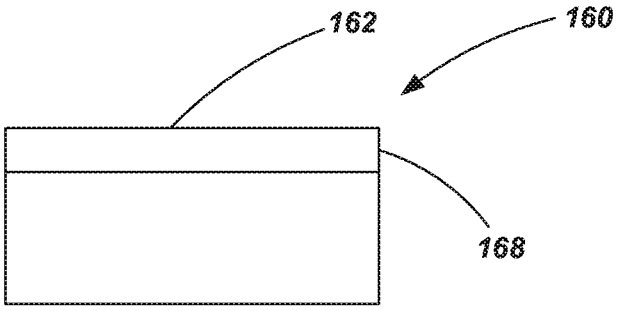
FIGS. 8-10 are cross-sectional views of wear inserts that may be used with a percussion drill bit in accordance to various embodiments of the present invention.
Figure 9:
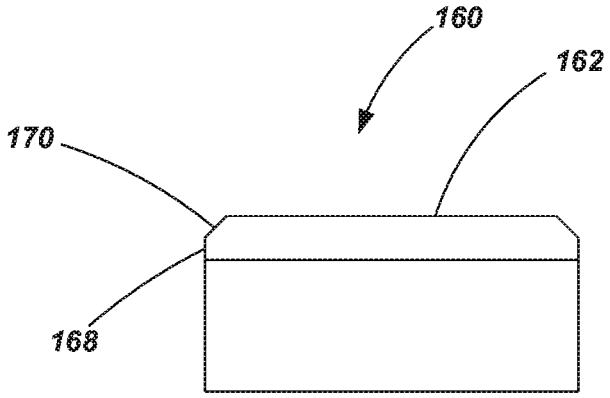
Figure 10:
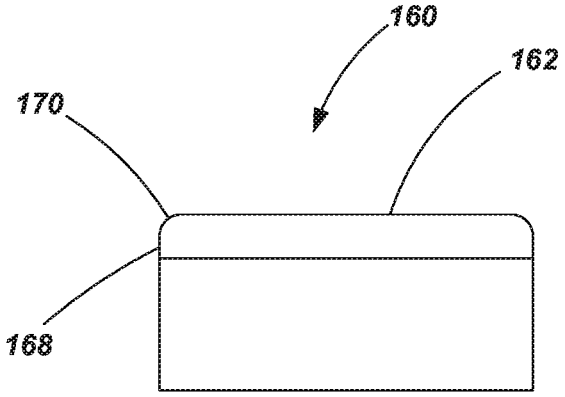

Referring briefly to FIGS. 8-10 examples of potential wear inserts 160 are shown. In one example, a wear insert 160 may be configured such that the upper wear surface 162 immediately adjoins a sidewall 168 of the insert 160 as seen in FIG. 8. Such an insert may be desired, for example, when the wear surface is intended to be substantially flush with the immediately adjacent surfaces of the drill bit 100.

In other embodiments, a transition surface may be provided between the wear surface 162 and the side wall 168. For example, the wear insert 160 may include a chamfer 170 positioned between the wear surface 162 and the side wall 168 as seen in FIG. 9, or a radius 172 positioned between the wear surface 162 and the side wall 168 as seen in FIG. 10. Such transition surfaces may be employed, for example, when the wear surface is "raised" relative to surrounding drill bit surfaces to help preventing chipping or breaking of the wear insert during drilling operations. In other embodiments, combinations of transitions may be used. For example, multiple chamfers, multiple radii, or combinations of one or more chamfers with one or more radii may be used to provide a transition surface.

The wear surface 162 of a given wear insert 160 may be substantially planar or may exhibit other geometries. For example, the wear surface 162 may be substantially arcuate. In one example, the wear surface 162 may be configured as substantially cylindrical (e.g., exhibiting a portion of surface of a cylinder). Thus, in one embodiment, the wear surface 162 of a wear insert 160 may be configured to effectually be an extension or a continuance of the surrounding surface of the drill bit 100. In one particular example, the wear surface 162 may be substantially cylindrical, with the wear insert placed in the shank 106 (such as shown in FIGS. 1-4), and exhibit substantially the same radius as the substantially cylindrical surface of the shank 106. In other embodiments, the wear surface may exhibit other geometries including, for example, complex surfaces which may include portions that are arcuate and portions which are planar.

In one embodiment, the wear inserts 160 may be configured such that the wear surface 162 is formed of a superhard or a superabrasive material. For example, in one embodiment, the wear insert 160 may include a polycrystalline diamond table or body bonded to a substrate. A surface of the polycrystalline diamond table may include the wear surface 162 of the insert 160. Such an insert 160 may be manufactured in a manner similar to that described above with respect to the percussion inserts 120 disposed in the face 108 of the drill bit, including the removal of catalyst material from the wear surface 162 of the wear insert 160 to a desired depth to improve the thermal characteristics of the wear insert 160. In other embodiments, the wear inserts 160 may comprise a cemented carbide material (e.g., a cobalt-cemented tungsten carbide material). Such a material may optionally includes diamond particles (natural or synthetic). In other embodiments, the wear inserts 160 may include, or be formed as, a coating or a hard facing material.

One example of a drill bit 100 may include a top hammer type drill bit having a face 106 that exhibits a diameter (measured substantially perpendicular to the longitudinal axis 164 of the bit) that is less than approximately 5 inches, for example, approximately 1 inch to approximately 3 inches. One or more percussion inserts 120 may be coupled to the face 108, the inserts exhibiting a domed or convex arcuate engagement surface. The drill bit may exhibit an overall length of approximately 3 inches to approximately 10 inches. The wall thickness of the shank 106 (i.e., the radial distance from the internal surface of the shank 106, adjacent the threads, to the external surface of the shank 106) may be between approximately 0.200 inch and approximately 0.375 inch.

A plurality of elongated, substantially cuboid wear inserts 160 (e.g., three) are distributed at substantially equal angles about the circumference of the shank 106 immediately adjacent the coupling end 116. The wear inserts 160 may exhibit a thickness (measured from the wear surface 162 to the opposing back surface) of less than 0.25 inch, preferably less than 0.0125 inch, and in one particular embodiment, approximately 0.063 inch. The wear inserts 160 may be coupled with the shank 106 so that the wear surfaces 162 radially extend beyond the immediately adjacent surface of the shank 106. For example, the wear surfaces may extend to a radial distance that is approximately 0.010 to 0.020 inch beyond the immediately adjacent surface of the shank 106 (in other words, $R_W$ may be approximately 0.010 to 0.020 inch greater than $R_S$). Optionally, the wear surfaces 162 may be positioned radially inward from the outer diameter of the head 104.

Figure 11:
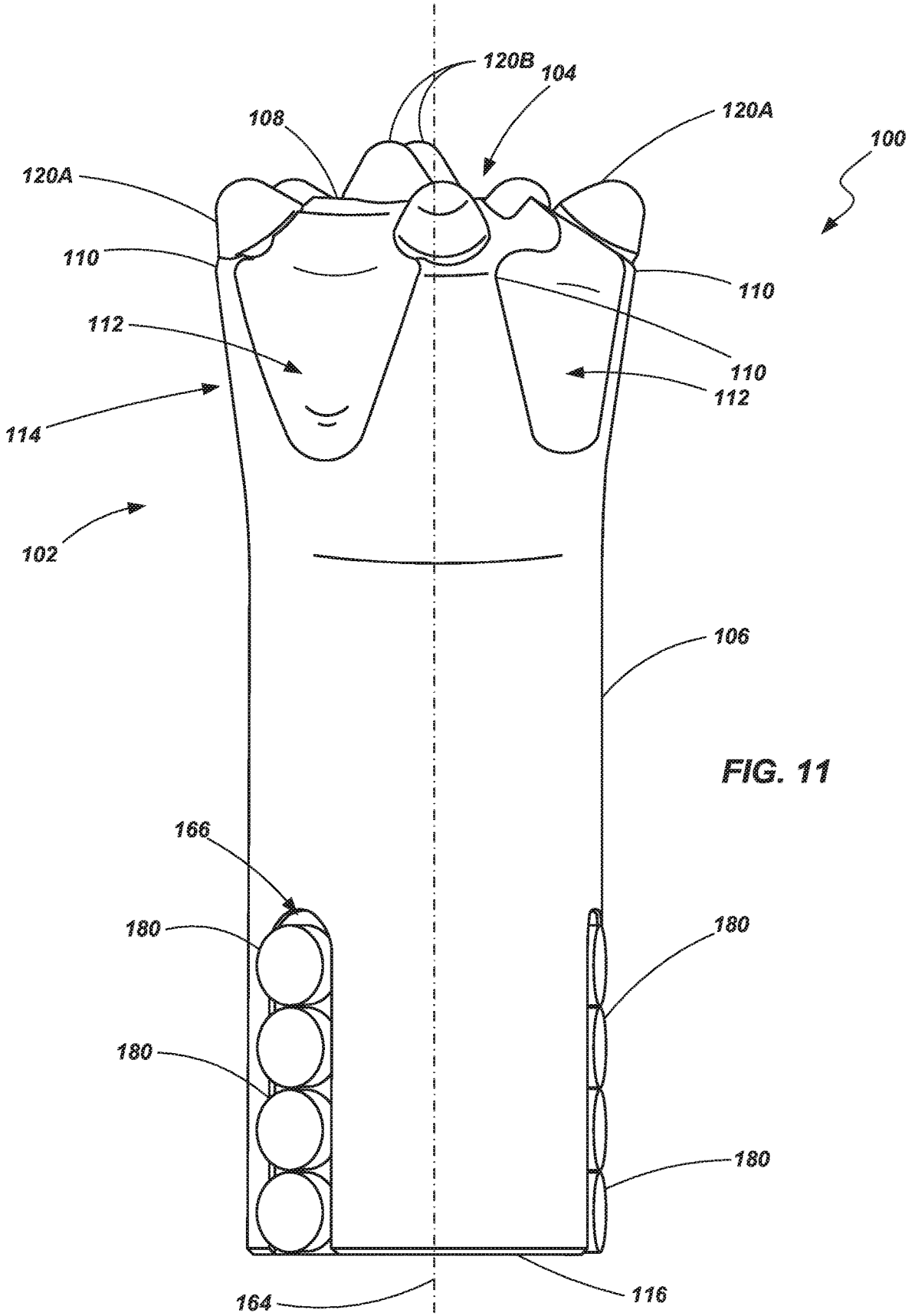
FIG. 11 is a side view of a percussion drill bit in accordance with another embodiment of the present invention.

Of course the drill bit 100 may be configured to exhibit other sizes and include wear inserts in different numbers, shapes, sizes and locations. For example, the substantially cuboid wear inserts 160 may be configured as generally round or substantially cylindrical inserts. In other embodiments, the wear inserts 160 may exhibit a substantially elliptical shape. In one example, as shown in FIG. 11, one or more cylindrical wear inserts 180 may be positioned in a drill bit 100 similar to embodiments described above (e.g., inserts 120). In one embodiment, a plurality of inserts 180 may be aligned with each other to collectively provide a wear surface along the elongated pocket such as shown in FIG. 11. If desired, such wear inserts 180 may extend substantially linearly along a defined angle relative to the longitudinal axis 164, or they may extend along a curve (e.g., a helical curve), rather than extending generally parallel to the longitudinal axis 164.

Figure 12:
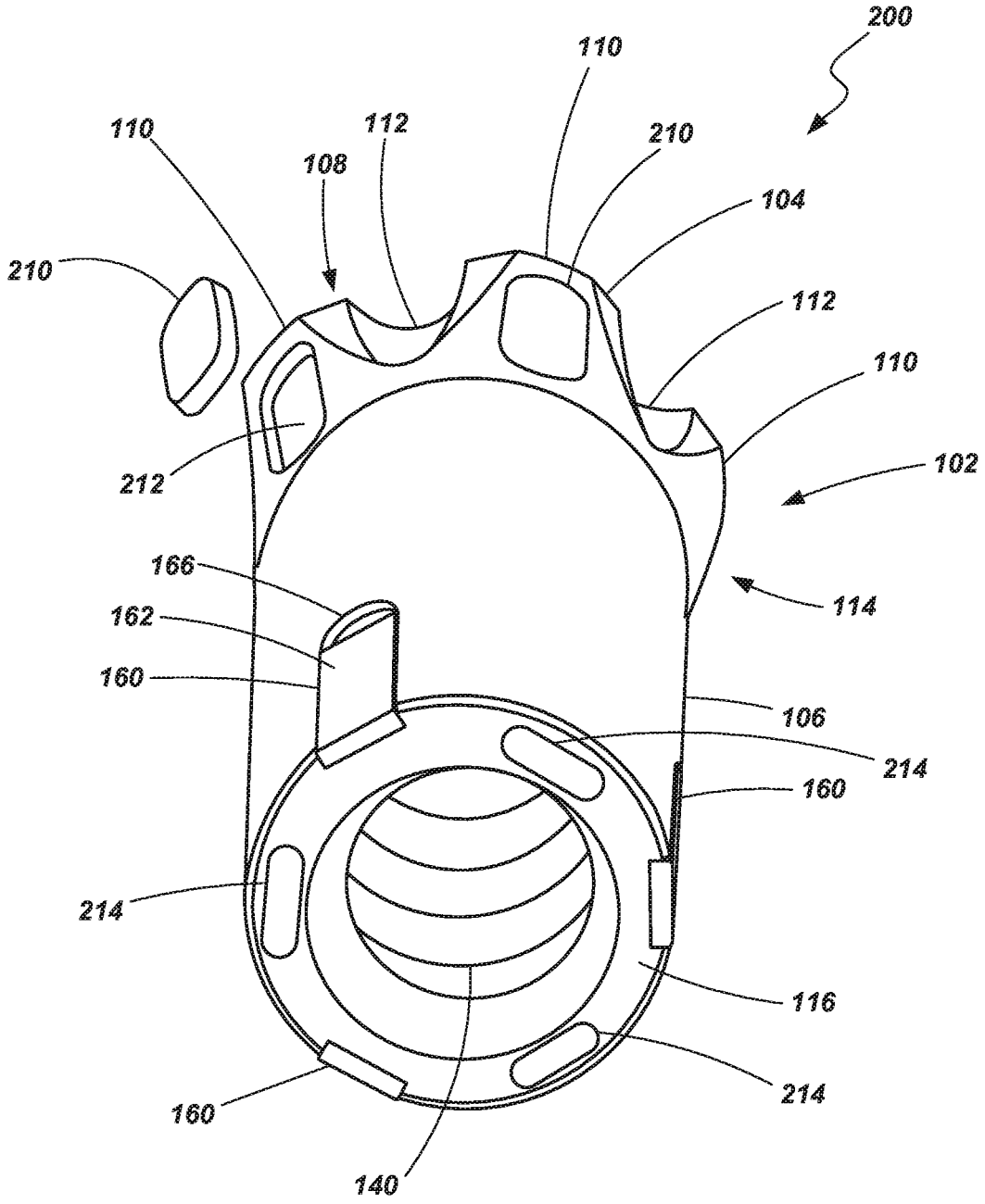
FIG. 12 is perspective view of a percussion drill bit in accordance with a further embodiment of the present invention.

Referring briefly to FIG. 12, another embodiment of a drill bit 200 is shown. The drill bit 200 is similar to the drill bit 100 described above and includes a bit body 102 having a head 104 and a shank 106. The head 104 may include a face 108 or a working end having a plurality of wings or gage portions 110 and a plurality of flutes 112 disposed between the gage portions 110. The drill bit 100 includes a skirt 114 which includes at least the tapered section that extends axially from the face 108 to the shank 106. A coupling end 116 is located opposite the face 108 at the end of the shank 106. The drill bit 200 may further include a plurality of inserts 120 positioned in the face 108 of the drill bit for engagement with a formation being drilled. A plurality of wear inserts 160 may be positioned in the shank 106, disposed immediately adjacent (or even contiguous with) the coupling end 116 such as been described above with respect to various embodiments.

The drill bit 200 further includes additional wear inserts. For example, additionally wear inserts 210 may be positioned within the skirt 114 at a location that axially trails the wing or gage portions 110. Such inserts 210 may be positioned in pockets 212 and brazed or otherwise affixed to the drill bit body 102. It is noted that one of the wear inserts 210 is shown in an "exploded" view, removed from its associated pocket 212 for illustrative purposes. Additionally, other wear inserts 214 may optionally be positioned in the generally axially-facing face of the coupling end 116. Such inserts 214 may also be positioned in associated pockets and coupled to the drill bit body 102 by brazing, interference fit or other appropriate means.

The wear inserts 210 and 214 may exhibit a variety of shapes and/or sizes and may formed using materials and manufacturing techniques such as described above with respect to other inserts (e.g., 120, 160 and 180). Similarly, the wear inserts 210 and 214 may be positioned relative to immediately adjacent surfaces such that they are substantially flush therewith or so that they extend beyond, or protrude a desired distance from, the immediately adjacent surfaces.

Figure 13:
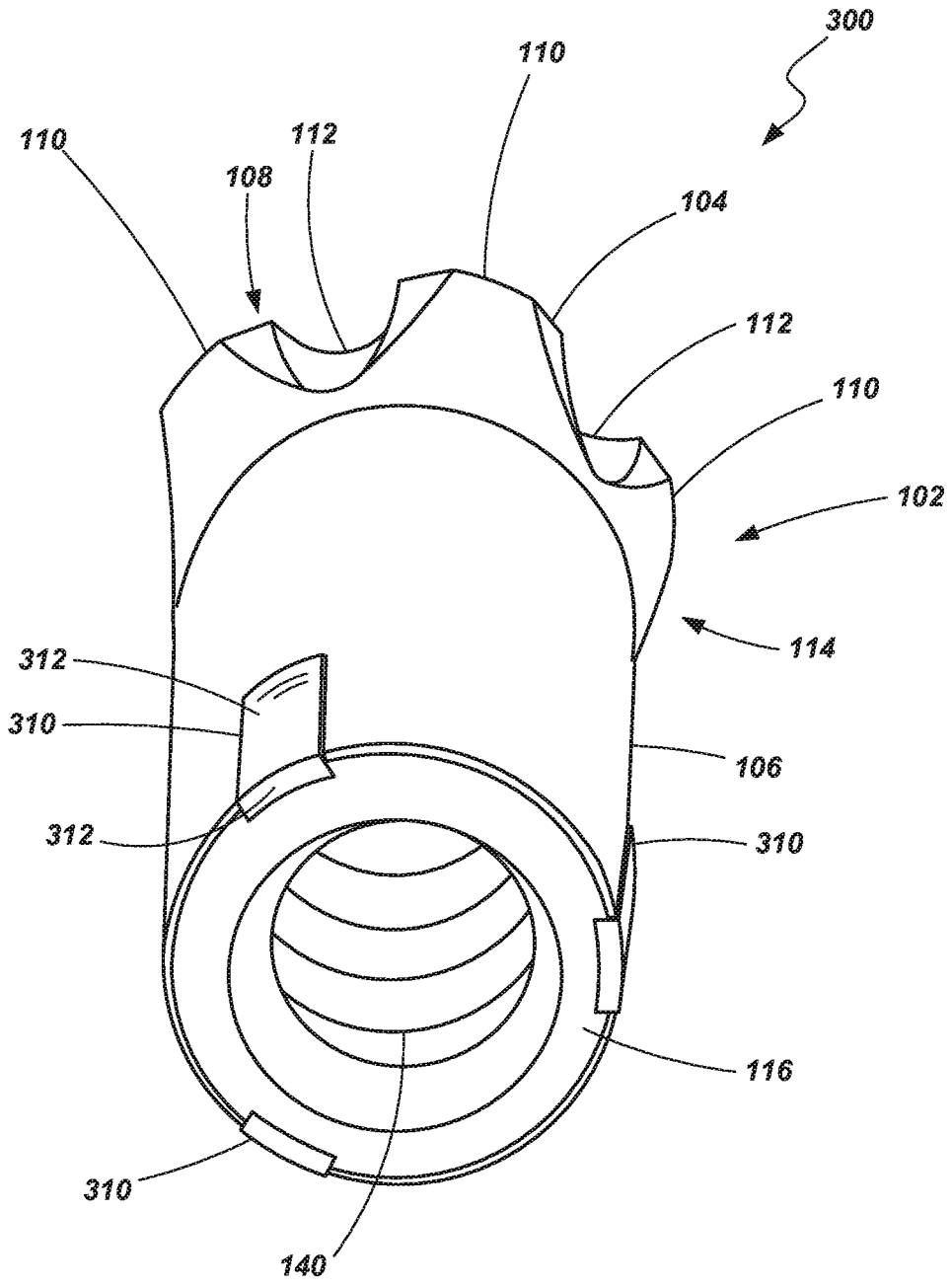
FIG. 13 is a perspective view of a percussion drill bit in accordance with another embodiment.

Referring to FIG. 13, a drill bit 300 is shown in accordance with another embodiment of the invention. The drill bit 300 includes and includes a bit body 102 having a head 104 and a shank 106. The head 104 may include a face 108 or a working end having a plurality of wings or gage portions 110 and a plurality of flutes 112 disposed between the gage portions 110. The drill bit 100 includes a skirt 114 which includes at least the tapered section that extends axially from the face 108 to the shank 106. A coupling end 116 is located opposite the face 108 at the end of the shank 106. The drill bit 300 may further include a plurality of inserts 120 (not shown in FIG. 13) positioned in the face 108 of the drill bit for engagement with a formation being drilled. A plurality of wear inserts 310 may be positioned in the shank 106, disposed immediately adjacent (or even contiguous with) the coupling end 116 such as been described above with respect to various embodiments. The wear inserts may include a first wear surface 312 that is substantially arcuate (e.g., generally convex) and which may protrude radially relative to the immediately adjacent surface of the shank 106. The wear inserts 310 may also include a second wear surface 314 associated with the coupling end 116 of the drill bit 300. In one embodiment, the second wear surface 314 may include a substantially planar surface which may extend substantially in a common plane with the end surface of the coupling end 116. In another embodiment, the second wear surface 314 may protrude axially from the end surface of the axial end.

The wear inserts 310 may be formed as ring segments from a substantially cylindrical ring. For example, a substantially cylindrical ring may be formed of a desired material and then the ring may be cut into individual segments. The resulting segments would, thus, be substantially cylindrical. Such a ring, and thus the resulting segments, may be formed using materials and manufacturing techniques such as described above with respect to other inserts (e.g., 120, 160 and 180).

Figure 14:
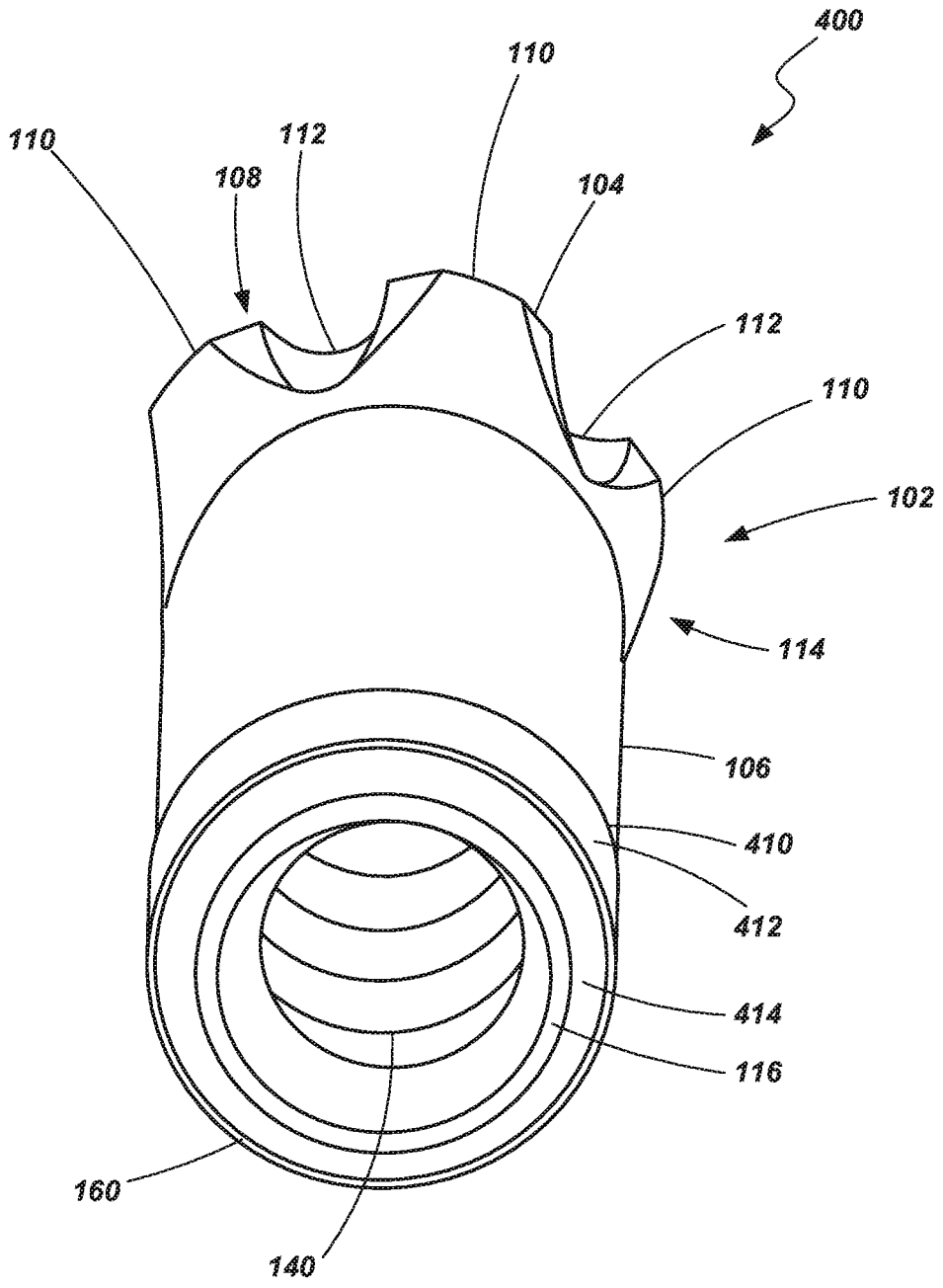
FIG. 14 is a perspective view of a percussion drill bit according to yet another embodiment of the invention.
Figure 15:
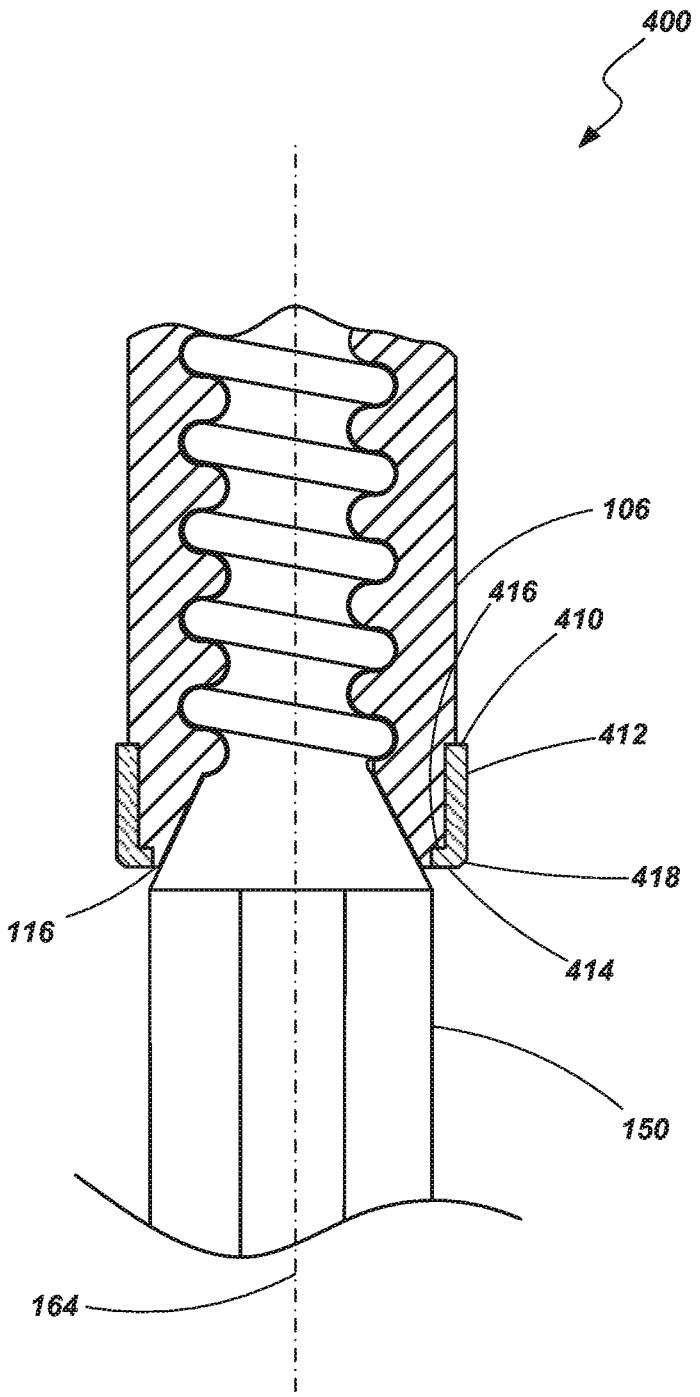
FIG. 15 is a cross-sectional view of a portion of the drill bit shown in FIG. 14.

Referring to FIGS. 14 and 15, another embodiment of a drill bit 200 is shown. The drill bit 400 includes and includes a bit body 102 having a head 104 and a shank 106. The head 104 may include a face 108 or a working end having a plurality of wings or gage portions 110 and a plurality of flutes 112 disposed between the gage portions 110. The drill bit 100 includes a skirt 114 which includes at least the tapered section that extends axially from the face 108 to the shank 106. A coupling end 116 is located opposite the face 108 at the end of the shank 106. The drill bit 300 may further include a plurality of inserts 120 (not shown in FIG. 13) positioned in the face 108 of the drill bit for engagement with a formation being drilled.

A wear insert or wear ring 410 may be coupled to the shank 106 (e.g., by brazing or other appropriate joining or fastening means) and disposed immediately adjacent (or even contiguous with) the coupling end 116 such as been described above with respect to various embodiments. The wear ring 410 may include a first wear surface 412 (e.g., a radial wear surface) that is substantially arcuate (e.g., substantially cylindrical) and which may exhibit substantially the same, or a slightly larger, radius curvature as compared to a radius of curvature of the shank 106. The wear ring 410 may also include a second wear surface 414 (e.g., an axial wear surface) associated with the coupling end 116 of the drill bit 400. In one embodiment, the second wear surface 414 may include a substantially planar surface which may extend substantially in a common plane with the end surface of the coupling end. In another embodiment, the second wear surface 414 may protrude axially from the end surface of the axial end 116.

As show in FIG. 15, wear ring 410 may include a leg 416 that extends radially inwardly and engages a shoulder portion of the shank 106. The leg 416 may provide added strength to the ring 410, enhance the ability to join or couple the wear ring 410 with the shank 106 of the drill bit 400, and provide the second wear surface 414 with an enlarged surface area. However, in other embodiments, the wear ring 410 may exclude the leg 416. Additionally, the wear ring 410 (as well as other wear inserts described herein) may include a chamfer 418 or other transition surface between the first wear surface 412 and the second wear surface 414, or between any two adjacent non-planar surfaces thereof. The ring may be formed using materials and manufacturing techniques such as described above with respect to other inserts (e.g., 120, 160 and 180). In yet a further embodiment, the ring may be cut into segments and disposed at selected circumferential positions as described with respect to FIG. 13 and or FIG. 15, respectively, or as otherwise desired.

As used herein, "about," "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term. While the invention may be susceptible to various modifications and alternative forms, specific embodiments have been shown by way of example in the drawings and have been described in detail herein. Any feature of a described embodiment may be combined with a feature of any other described embodiment without limitation. Additionally, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A drill bit comprising:

a bit body having a first end and a second end, a longitudinal axis extending through the first end and the second end, the bit body comprising:

a head at the first end, the head including a face and at least one wing extending radially from the face, the at least one wing exhibiting a first radius measured from the longitudinal axis;

a skirt extending axially from, and radially inward from, the at least one wing;

a shank extending axially from the skirt to the second end;

at least a first insert having a convex engagement surface coupled to the face;

at least a second insert having a convex engagement surface coupled to the at least one wing;

an elongated pocket extending substantially longitudinally along the bit body;

at least one wear insert disposed at least partially within the elongated pocket and protruding from the bit body.

2. The drill bit of claim 1, wherein the at least one wear insert comprises a superabrasive material, hardfacing, or a cemented carbide material and includes an elongated wear insert disposed at least partially within the elongated pocket or a plurality of wear elements disposed at least partially within the elongated pocket.

3. The drill bit of claim 2, wherein the superabrasive material comprises polycrystalline diamond.

4. The drill bit of claim 2, wherein the cemented carbide material includes tungsten carbide.

5. The drill bit of claim 1, wherein the at least one wear insert is positioned between the second end of the bit body and a transition between the skirt and the at least one wing.

6. The drill bit of claim 4, wherein the at least one wear insert is immediately adjacent the second end.

7. The drill bit of claim 1, wherein the at least one wing includes a plurality of wings circumferentially, wherein each wing of the plurality of wings is separated from an adjacent wing of the plurality of wings by a flute of a plurality of flutes.

8. The drill bit of claim 7, wherein the at least one second insert includes a plurality of inserts, each of the plurality of inserts being coupled with a wing of the plurality of wings.

9. The drill bit of claim 1 wherein the shank exhibits a second radius that is less than the first radius.

10. The drill bit of claim 9, wherein the first radius is between approximately 1 inch and approximately 3 inches.

11. The drill bit of claim 1, wherein the at least one first insert and the at least one second insert each include a first portion that exhibits a substantially semi-spherical surface and a second portion that exhibits a substantially cylindrical geometry.

12. The drill bit of claim 1, wherein the at least one first insert and the at least one second insert each include a polycrystalline body bonded to a substrate.

13. A method of forming a drill bit, the method comprising:

providing a monolithic bit body comprising a head, a skirt and a shank, the head including a face and at least one wing portion that exhibits a first radius relative to a longitudinal axis of the bit body;

coupling at least one insert to the face of the bit body, the at least one insert including a convex engagement surface;

coupling at least one wear insert at least partially within an elongated pocket extending substantially longitudinally along the bit body and arranging the at least one wear insert such that a wear surface of the at least one wear insert protrudes from immediately adjacent surfaces of the bit body.

14. The method according to claim 13, wherein coupling at least one wear insert to the bit body includes coupling an elongated wear insert or a plurality of wear elements at least partially within the elongated pocket on the bit body, the elongated wear insert or the plurality of wear elements comprising a superabrasive material, a cemented carbide material, or a hardfacing material.

15. The method according to claim 13, further comprising defining the first radius to be approximately 3 inches or less.

16. The method according to claim 13, wherein providing a monolithic bit body includes providing a bit body comprising steel.

17. The method according to claim 13, wherein providing a monolithic bit body includes providing a bit body with a shank having a second radius that is less than the first radius and wherein the skirt tapers from the first radius to the second radius.

18. The method according to claim 13, wherein coupling at least one insert to the face of the bit body includes coupling at least a first insert to the face portion and at least a second insert to the at least one wing portion.

19. The method according to claim 18, wherein coupling at least one wear insert to the bit body includes coupling a plurality of wear inserts to the bit body.

20. The method according to claim 18, wherein coupling at least one wear insert to the bit body includes coupling the at least one insert to the bit body such that the wear surface is positioned at a radius from the longitudinal axis that is less than the first radius and greater than the second radius.

* * * * *